US008916092B2

(12) United States Patent
Wang et al.

(10) Patent No.: US 8,916,092 B2
(45) Date of Patent: Dec. 23, 2014

(54) NI-BASED ALLOY, AND TURBINE ROTOR AND STATOR BLADE FOR GAS TURBINE

(75) Inventors: Yuting Wang, Hitachi (JP); Akira Yoshinari, Hitachinaka (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 395 days.

(21) Appl. No.: 13/489,481

(22) Filed: Jun. 6, 2012

(65) Prior Publication Data

US 2012/0328429 A1 Dec. 27, 2012

(51) Int. Cl.

| | |
|---|---|
| ***C22C 19/05*** | (2006.01) |
| ***F01D 5/14*** | (2006.01) |
| ***F01D 9/02*** | (2006.01) |
| ***F01D 9/04*** | (2006.01) |
| ***F01D 5/28*** | (2006.01) |
| ***C22F 1/10*** | (2006.01) |

(52) U.S. Cl.

CPC ..... *F01D 9/041* (2013.01); *C22C 19/056* (2013.01); *F01D 5/28* (2013.01); *C22F 1/10* (2013.01)

USPC ..... 420/448; 415/208.1; 416/241 R

(58) Field of Classification Search

CPC ..... C22C 19/056; C22F 1/10; F01D 5/28; F01D 9/041

USPC ..... 420/448; 415/208.1; 416/241 R

See application file for complete search history.

(56) References Cited

U.S. PATENT DOCUMENTS

| | | | |
|---|---|---|---|
| 3,720,509 | A | 3/1973 | Danesi |
| 2004/0221925 | A1 | 11/2004 | Tamaki et al. |

FOREIGN PATENT DOCUMENTS

| | | | |
|---|---|---|---|
| EP | 2 354 262 | A1 | 8/2011 |

OTHER PUBLICATIONS

EP Search Report of Appln. No. 12171351.5 dated Nov. 22, 2012 in English.

*Primary Examiner* — Jessee Roe

(74) *Attorney, Agent, or Firm* — Antonelli, Terry, Stout & Kraus, LLP.

(57) ABSTRACT

A Ni-based alloy including chromium, cobalt, aluminum, titanium, tantalum, tungsten, molybdenum, niobium, carbon, and boron, the balance being nickel and incidental impurities, is provided. The alloy has an alloy composition of, on the basis of mass percent, chromium: 13.10% to 16.00%, cobalt: 8.00% to 12.50%, aluminum: 2.30% to 3.50%, titanium: 4.80% to 5.50%, tantalum: 0.40% to less than 1.00%, tungsten: 4.50% to 6.00%, molybdenum: 0.10% to 1.50%, niobium: 0.60% to 1.70%, carbon: 0.01% to 0.20%, boron: 0.005% to 0.02%, and the balance: nickel and incidental impurities.

11 Claims, 7 Drawing Sheets

NI-BASED ALLOY, AND TURBINE ROTOR AND STATOR BLADE FOR GAS TURBINE

BACKGROUND OF THE INVENTION (1) Field of the Invention

The present invention relates to a Ni-based alloy having better high-temperature strength and more excellent ductility as an ordinary casting material, and a turbine rotor and stator blade for a gas turbine using the Ni-based alloy.

(2) Description of Related Art

In recent years, due to increase in environmental awareness such as saving of fossil fuels, reduction in the emission amount of carbon dioxide, and prevention of global warming, thermal efficiency of an internal combustion engine has been improved. It is known that thermal engines such as gas turbines and jet engines can enhance thermal efficiency most effectively by being operated with the high temperature side of the Carnot's cycle set at a higher temperature. With elevation of the temperature of the turbine inlet, importance of improvement and development of the material for use in high-temperature components of gas turbines, that is, combustors and turbine rotor or stator blades has been increased.

As for the material, in order to take measures to the elevation of the temperature, a Ni-based heat-resistant alloy which is more excellent in high-temperature strength is applied to rotor blades, and many Ni-based alloys are used for the rotor blades at present. However, a Co-based alloy which is excellent in corrosion resistance and weldability is used for the heat-resistant material used in gas turbine stators.

Due to elevation of combustion temperature (turbine inlet temperature) along with improvement in efficiency of recent years, use of a Ni-based alloy which is more excellent in high-temperature strength than a Co-based alloy has been considered. In order to enhance the strength of a Ni-based alloy, large amounts of W, Mo, Ta, Co and the like which are solid solution strengthening elements are added. In addition, by adding Al, Ti and the like to utilize precipitation strength of a $\gamma'Ni_3(Al, Ti)$ phase which is a reinforcement phase, the Ni-based alloy has excellent high-temperature strength and thermal fatigue characteristics.

However, since a Ni-based alloy is inferior to a Co-based alloy in workability such as weldability and ductility, it is difficult at present to apply a Ni-based alloy to gas turbine stator blades.

For example, an alloy which has a large precipitation amount of a γ' phase and is excellent in strength characteristics is excellent in the high-temperature strength and creep characteristics, but is significantly reduced in ductility. In contrast with this, an alloy (U.S. Pat. No. 3,720,509) which is improved in workability such as ductility by reducing the precipitation amount of a γ' phase is required to improve in strength corresponding to elevation of temperature in order to be applied to a rotor blade.

BRIEF SUMMARY OF THE INVENTION

As the amount of precipitation of a γ' phase becomes larger in order to pursue high strength, there seems to be a tendency that the ductility of the alloy is reduced. It is difficult to achieve a good balance between high-temperature strength and ductility.

It is an object of the present invention to provide a Ni-based alloy which provides good high-temperature strength and excellent ductility as an ordinary casting material, and is preferable for an industrial gas turbine rotor blade or stator blade.

A Ni-based alloy of the present invention comprises chromium, cobalt, aluminum, titanium, tantalum, tungsten, molybdenum, niobium, carbon, and boron, the balance being nickel and incidental impurities, wherein the alloy has an alloy composition of, on the basis of mass percent, chromium: 13.10% to 16.00%, cobalt: 8.00% to 12.50%, aluminum: 2.30% to 3.50%, titanium: 4.80% to 5.50%, tantalum: 0.40% to less than 1.00%, tungsten: 4.50% to 6.00%, molybdenum: 0.10% to 1.50%, niobium: 0.60% to 1.70%, carbon: 0.01% to 0.20%, boron: 0.005% to 0.02%, and the balance: nickel and incidental impurities.

According to the present invention, the Ni-based alloy for ordinary casting which achieves a good balance between high-temperature strength and ductility is provided. Further, the alloy of the present invention contains carbon and boron which have the effect in strengthening crystal grain boundaries, and hafnium which has the effect in suppression of crystal boundary cracks at the time of casting. Thus, the alloy has an alloy composition which is also suitable for using as a unidirectional solidification material.

Other objects, features and advantages of the invention will become apparent from the following description of the embodiments of the invention taken in conjunction with the accompanying drawings.

DETAILED DESCRIPTION OF THE INVENTION

Hereinafter, the present invention will be described in detail.

Figure 6:
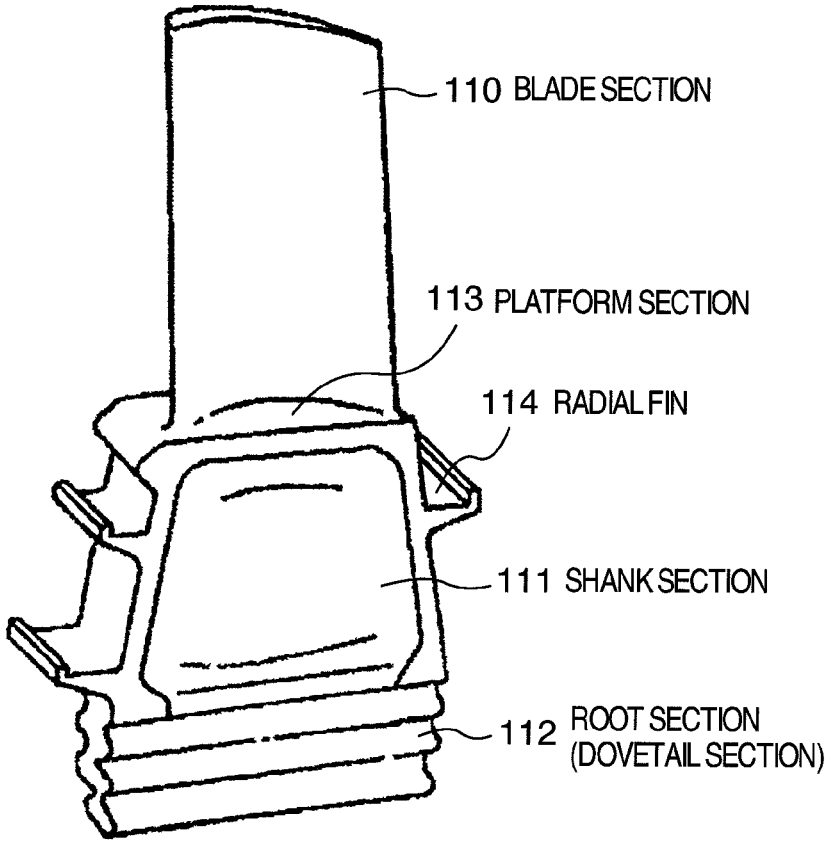
FIG. 6 is a view showing one example of a shape of a rotor blade for a gas turbine.

First, FIG. 6 shows one example of a turbine rotor blade for an industrial gas turbine.

A turbine rotor blade 1 is configured by a blade section 110, a shank section 111 and a root section (dovetail section) 112, and has a size of 10 to 100 cm and a weight of approximately 1 to 10 kg. Further, the turbine rotor blade 1 includes a platform section 113 and a radial fin 114. The turbine rotor blade is a rotary component having a complicated cooling structure in an inside thereof, and is exposed to a severe environment such that a centrifugal force during rotation and load of thermal stress caused by start-up and shutdown are repeatedly applied. As the basic material characteristics, excellent high-temperature creep strength, and excellent oxidation resistance and corrosion resistance to a high-temperature combustion gas atmosphere are required.

Figure 7:
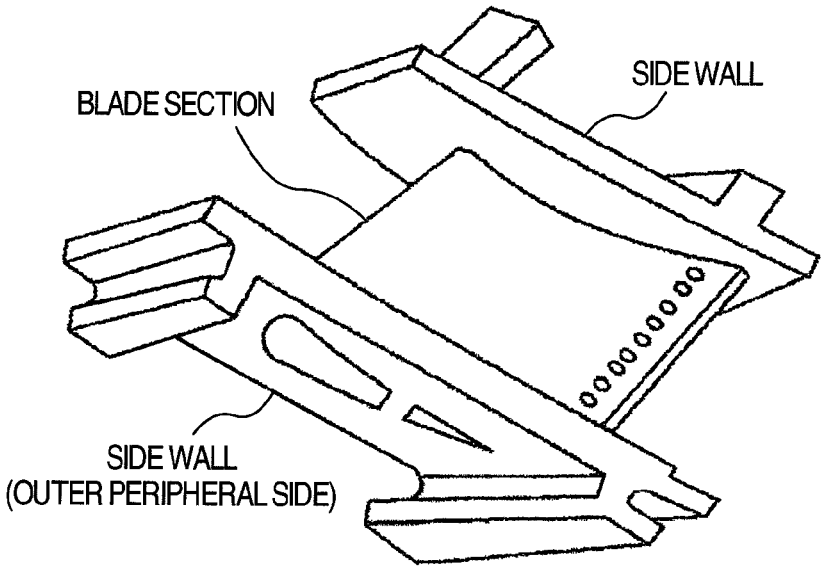
FIG. 7 is a view showing one example of a shape of a stator blade for the gas turbine.

Meanwhile, as shown in FIG. 7, a turbine stator blade has a vane extending along a blade axis. A base platform extending orthogonally with respect to the blade axis in order to fix the turbine blade to each support is integrally formed at a terminal end side of the vane. The turbine stator blade material requires good high-temperature strength and thermal fatigue strength. Accordingly, development of a casting alloy having an excellent balance of these characteristics is considered to be very important. As the result of study for alloy which is an ordinary casting alloy and achieves a good balance between creep strength and ductility, the present inventors have finally found the present invention.

As production means of blades for ordinary gas turbines, there are some methods such as ordinary casting, unidirectional solidification casting and single crystal casting. Unidirectional solidification alloys and single crystal alloys are mainly used in rotor blades of compact and lightweight jet engines (aircraft gas turbines). However, since the casting processes of the blades using unidirectional solidification alloys and single crystal alloys are complicated, the casing yield ratio is decreased when the blades are casted. In particular, since the blades for industrial gas turbines have large shapes and complicated shapes, the casting yield ratio thereof is low, and therefore, there arises the problem that the products become expensive.

Thus, the present inventors studied the alloy which achieves a better balance between high-temperature strength and ductility than the conventional material in particular as an ordinary casting alloy by balancing respective alloy additive elements. Hereinafter, the functions of respective components contained in the Ni-based alloy of the present invention, and a preferable composition range will be described.

Cr: 13.10 to 16.00 mass %

Cr acts as a solid solution strengthening element and forms a dense oxide film to contribute to oxidation resistance and high temperature corrosion resistance under a corrosive atmosphere at a high temperature. In particular, the more the Cr content is increased, the larger the effect to improve corrosion resistance against molten salt corrosion becomes. The effect appears more remarkably after the content of Cr exceeds 13.10 mass %. However, in the alloy of the present invention, since large amounts of Ti, W, Ta and the like are added, a brittle TCP phase is precipitated to reduce high-temperature strength if the Cr amount becomes too large. Therefore, the upper limit of Cr is desirably set at 16.0 mass % in consideration for a balance between Cr and the other alloy elements. In this composition range, both high strength and high corrosion resistance can be obtained. The range is preferably from 13.10 to 14.30 mass %, and is more preferably from 13.70 to 14.10 mass %.

Co: 8.00 to 12.50 mass %

Co lowers the solid solution temperature of a γ' phase, and has the effect of facilitating solution heat treatment. Especially in the case where Co is used in partial solution as in the alloy of the present invention, the solution rate can be made increased even at a low heat treatment temperature. In order to obtain the effect, addition of 8% or more is necessary at the minimum. However, excessive addition of Co makes the γ' phase unstable, and rather leads to reduction in strength. Accordingly, Co needs to be set at 12.50% at the maximum. In this composition range, good high-temperature strength is obtained. The range is preferably from 8.50 to 11.00 mass %, and is more preferably from 9.10 to 10.80 mass %.

Al: 2.30 to 3.50 mass %

Al is an essential element to form a γ' phase ($Ni_3Al$), and addition of 2.30% or more is required at the minimum. Al forms an $Al_2O_3$ protection film, and thereby, improves oxidation resistance and corrosion resistance. However, excessive addition of Al reduces the solid solution strength of the γ' phase, and rather reduces the high-temperature strength, and therefore, the addition amount needs to be set at 3.50% at the maximum. Taking into consideration a balance between high-temperature strength, and oxidation resistance and corrosion resistance in this composition range, the range is preferably from 2.70 to 3.40 mass %, and is more preferably from 3.00 to 3.40 mass %.

Ti: 4.80 to 5.50 mass %

Ti prevents formation of composite oxides of Cr and Al, and has the effect of improving corrosion resistance of the alloy. In order that a remarkable effect appears in the corrosion resistance against molten salt corrosion, the content of 4.80 mass % or more is needed. However, if addition of Ti exceeds 5.50 mass %, the oxidation resistance characteristics significantly degrade and a η phase which is an embrittlement phase is further precipitated. In addition, since the precipitation amount of the γ' phase increases along with the addition amount of Ti as the formation element of the γ' phase, the upper limit needs to be set at 5.5 mass % in consideration for the precipitation amount of the γ' phase. Taking into consideration the balance between the high-temperature strength, and corrosion resistance and the oxidation resistance characteristics, in the alloy containing 13.1 to 15.0 mass % of Cr as the alloy of the present invention, the range is preferably from 4.80 to 5.30 mass %, and is more preferably from 4.80 to 5.10 mass %.

Ta: 0.40 to less than 1.00 mass %

Ta is an element which is solidified in the form of [$Ni_3$(Al, Ta)] in a γ' phase, and has the function of improving the creep strength by solid solution strengthening. In order to make the absolute value of lattice constant mismatch between a γ phase and the γ' phase smaller, the amount of Ta needs to be made less than 1.0%. In order to keep high-temperature strength, addition of 0.40% or more is needed. If the amount of Ta is made less than 0.5%, the amount of Nb is desired to be increased. Accordingly, Ta+Nb is preferably set to at least 1.50%. Further, if Ta+Nb is excessively added, stability of the γ' phase is worsened, and the strength is reduced on the contrary. Therefore, Nb+Ta is preferably set at 2.50% or less at the maximum. Taking into consideration the balance between high-temperature strength and ductility, the range is preferably from 0.50 to 0.90 mass %, and is more preferably from 0.60 to 0.90 mass %.

W: 4.50 to 6.00 mass %

W mainly strengthens solid solution of the γ phase. W is a solid solution strengthening element similarly to Mo, and contributes to improvement of the rigidity coefficient and reduction of the diffusion coefficient. However, W has less secular migration into a μ phase as compared with Mo and stably contributes to strengthening for a long period of time. When the lattice constant mismatch between the γ phase and the γ' phase is reduced more, the strength of the interface of the γ and γ' phases is improved, and the high-temperature creep strength is improved. W is an element which mainly enters the γ phase side, and conversely, Ta is an element which mainly enters the γ' phase side which is a precipitated phase. In the alloy having a large amount of W, the lattice constant at the γ phase side is large, and the lattice constant mismatch which is generally defined by (the lattice constant of the γ' phase−the lattice constant of the γ phase)/(the lattice constant average of both phases) is small. Accordingly, in order to decrease the lattice constant mismatch between the γ phase and the γ' phase, the amount of W is 4.5% or more at the minimum. However, excessive addition of W worsens the phase stability of the alloy and leads to precipitation of a TCP phase or the like, and reduces corrosion resistance. Thus, the amount of W needs to be restricted to 6.0% at the maximum.

When a priority is placed on phase stability, the range is preferably from 4.80 to 5.50 mass %, and is more preferably from 4.80 to 5.40 mass %.

Mo: 0.10 to 1.50 mass %

Mo has the effect similar to that of W, and therefore, can be replaced with part of W in accordance with necessity. Further, Mo elevates the solid solution temperature of the γ' phase, and therefore, has the effect of improving the creep strength similarly to W. In order to obtain such an effect, the content of 0.1 mass % or more is needed. As the content of Mo increases, the creep strength is also improved. Further, since Mo has a lower specific gravity as compared with W, the weight of the alloy can be reduced.

Meanwhile, Mo reduces oxidation resistance and the corrosion resistance of the alloy. In particular, as the content of Mo increases, the oxidation resistance characteristics are significantly degraded, and therefore, the upper limit of the content needs to be set at 1.5 mass %. Further, the content of Mo which causes matrix deterioration due to precipitation of the μ phase is reduced, and instead, W, which is useful in matrix strengthening, is added in large amount. Accordingly, in the case where the corrosion resistance and the oxidation resistance characteristics at high temperature are made substantially equivalent to those of the conventional alloy and a priority is placed on the creep strength, the range is preferably from 0.60 to 1.40 mass %, and is more preferably from 0.70 to 1.30 mass % in the composition range of the present invention.

Nb: 0.60 to 1.70 mass %

Nb prevents formation of composite oxides of Cr and Al, and has the effect of improving the corrosion resistance of the alloy. Meanwhile, the effect of solid solution strengthening for the γ' phase is higher than that of Ti, while the effect is smaller than that of Ta. Accordingly, Nb is an effective element which can improve the corrosion resistance without reducing high-temperature strength, and 0.60% or more Nb needs to be added. However, in order to keep the phase stability of the γ' phase, the addition amount of Nb needs to be set at 1.70% or less. When a priority is especially placed on the corrosion resistance, addition of 1.0% or more Nb is preferable. Taking into consideration the balance between the high-temperature strength, and the corrosion resistance and the oxidation resistance characteristics, the range is preferably from 0.70 to 1.60 mass %, and is more preferably from 0.80 to 1.50 mass %.

C: 0.01 to 0.20 mass %

C is an element which forms an MC type carbide with Ta, Nb and the like, forms M23C6 and M6C type carbides with Cr, W, Mo and the like, and has the effect of strengthening crystal grain boundaries by preventing the crystal grain boundaries from moving at high temperature. Thus, C plays an especially important role in the present invention. In order to make this effect of an ordinary casting material exerted, 0.05% or more C is needed to be added at the minimum. Further, when both strength and ductility need to be increased, 0.10% or more C is preferably added. However, if the amount of C is made too large, the effective elements for solid solution strengthening of the γ phase and the γ' phase are taken by carbides, and the high-temperature strength is rather reduced. Further, an excessive amount of carbide reduces fatigue strength. Accordingly, the upper limit of C needs to be restricted to 0.20%.

B: 0.005 to 0.02 mass %

B buries incommensurate portions of crystal grain boundaries, and has the effect of increasing the bonding force of the crystal grain boundaries. In the alloy of the present invention, the addition of 0.005% B is needed at the minimum. When higher grain boundary strength is required as an ordinary casting material, 0.010% or more B is desirably added. However, since B significantly reduces the melting point of a Ni-based alloy, boron needs to be restricted to 0.02% at the maximum.

Hf: 0 to 2.00 mass %, Re: 0 to 0.50 mass %, Zr: 0 to 0.05 mass %

Hf, Re and Zr segregate in crystal grain boundaries and slightly improve the strength of the crystal grain boundaries. However, most of them form intermetallic compounds with Ni, that is, $Ni_3Zr$ and the like in the crystal grain boundaries. The intermetallic compounds reduce the ductility of the alloy, and have low melting points. Thus, the intermetallic compounds have less effective action, since, for example, they reduce the melting temperature of the alloy and narrow the solidification treatment temperature range. Accordingly, the upper limits thereof are set at 2.00 mass %, 0.50 mass %, and 0.05 mass %, respectively. More preferably, Hf is set at 0 to 0.10 mass %, Re is set at 0 to 0.10 mass %, and Zr is set at 0 to 0.03 mass %.

O: 0 to 0.005 mass %, N: 0 to 0.005 mass %

Oxygen and nitrogen are impurities. Both of them are often brought in from an alloy raw material. O is also included from a crucible. O and N exist in lump forms in the alloy, as oxides ($Al_2O_3$) and nitrides (TiN or AlN). If oxides and nitrides are present in a cast product, they become the starting points of cracks during creep deformation to reduce the creep rupture life, and become the starting points of occurrence of fatigue cracks to reduce the fatigue life. In particular, oxygen appears on the cast product surface as an oxide, and thereby becomes the surface defect of the cast product to be the cause of decrease of the yield ratio of cast products. Therefore, the lower the contents of these elements, the better it is. However, when actual ingot is produced, an oxygen-free and nitrogen-free state cannot be realized. Thus, as the range which does not degrade the characteristics significantly, each of both the elements are desired to be 0.005 mass % or less.

The Ni-based alloy which comprises the above described respective components with the balance being Ni and incidental impurities provides high high-temperature strength and ductility.

Example

Hereinafter, the Ni-based alloys used in the test in the present examples are shown. The compositions (mass %) of the Ni-based alloys are shown in Table 1.

TABLE 1

| Ni-Based Alloy Composition | | | | | | | | | | | | | |
|---|---|---|---|---|---|---|---|---|---|---|---|---|---|
| Alloy | Alloy Compositions (mass %) | | | | | | | | | | | | |
| No. | Cr | Co | Mo | W | Nb | Ta | Ti | Al | C | B | Ni | Ta + Nb | Remark |
| 1 | 13.8 | 10.5 | 1.2 | 5.6 | 1.1 | 0.3 | 4.9 | 3.2 | 0.145 | 0.015 | Bal. | 1.4 | Comparative Example |

TABLE 1-continued

| Ni-Based Alloy Composition | | | | | | | | | | | | | |
|---|---|---|---|---|---|---|---|---|---|---|---|---|---|
| Alloy | Alloy Compositions (mass %) | | | | | | | | | | | | |
| No. | Cr | Co | Mo | W | Nb | Ta | Ti | Al | C | B | Ni | Ta + Nb | Remark |
| 2 | 13.7 | 9.5 | 1.3 | 4.9 | 0.8 | 0.6 | 4.8 | 3.1 | 0.145 | 0.15 | Bal. | 1.4 | Comparative Example |
| 3 | 13.9 | 10.1 | 1 | 5.5 | 1.1 | 0.6 | 5.1 | 3.1 | 0.145 | 0.015 | Bal. | 1.7 | Present Invention |
| 4 | 13.2 | 10.4 | 1 | 5.3 | 1.1 | 0.7 | 5 | 2.9 | 0.145 | 0.015 | Bal. | 1.8 | Present Invention |
| 5 | 14.1 | 9.8 | 1.2 | 5.4 | 1.3 | 0.5 | 4.9 | 2.7 | 0.145 | 0.015 | Bal. | 1.8 | Present Invention |
| 6 | 13.8 | 10.5 | 1.2 | 5 | 1.1 | 0.8 | 4.9 | 2.8 | 0.145 | 0.015 | Bal. | 1.9 | Present Invention |
| 7 | 13.5 | 10.2 | 1 | 4.9 | 1.1 | 0.8 | 4.9 | 3.2 | 0.145 | 0.015 | Bal. | 1.9 | Present Invention |
| 8 | 13.5 | 9.9 | 0.9 | 5.7 | 1.1 | 0.6 | 5.1 | 3.1 | 0.145 | 0.015 | Bal. | 1.7 | Present Invention |
| 9 | 12.5 | 10.3 | 1 | 4.6 | 1.3 | 0.8 | 5 | 3.3 | 0.145 | 0.015 | Bal. | 2.1 | Present Invention |
| 10 | 13.4 | 10.5 | 1.1 | 4.3 | 1.1 | 0.7 | 4.8 | 3.2 | 0.145 | 0.015 | Bal. | 1.8 | Comparative Example |
| 11 | 13.6 | 10.6 | 1.1 | 6.1 | 1.2 | 0.7 | 5.4 | 3.3 | 0.145 | 0.015 | Bal. | 1.9 | Comparative Example |
| 12 | 13.1 | 10.4 | 1.2 | 5.3 | 1.5 | 1.1 | 5.2 | 3.1 | 0.145 | 0.015 | Bal. | 2.6 | Comparative Example |
| 13 | 13.5 | 10 | 1.1 | 5.2 | 1.8 | 0.9 | 4.9 | 3.2 | 0.145 | 0.015 | Bal. | 2.7 | Comparative Example |

Alloys Nos. 3 to 9 represent the alloy compositions showing the present invention, and Alloys Nos. 1, 2 and 10 to 13 represent the alloy compositions showing comparative examples. As for each of the test pieces, master ingot and weighed alloy elements were dissolved in an alumina crucible, and were cast into a flat plate with a thickness of 14 mm. The casting mold heating temperature was 1373 K. The casting temperature was 1713 K. A ceramics casting mold with alumina quality was used as the casting mold. After casting, each of the test pieces was subjected to solution heat treatment and ageing heat treatment. In order to make the alloy composition uniform, solution heat treatment was performed at 1480 K for 2 hours. After the solution heat treatment, the test piece was air-cooled. The conditions of the following ageing heat treatment were 1366 K/4 hours/air-cooling+1340 K/4 hours/air-cooling+1116 K/16 hours/air-cooling for all the alloys. Thereafter, the test piece was worked, and a creep rupture test, corrosion, oxidation and room temperature tension tests were carried out.

From the heat-treated test pieces, creep test pieces each with a parallel part diameter of 6.0 mm and a parallel part length of 30 mm, high-temperature oxidation test pieces each with a length of 25 mm, a width of 10 mm and a thickness of 1.5 mm, and high-temperature corrosion test pieces each in the shape of a cube of 15 mm by 15 mm by 15 mm were cut out. Microstructures of the alloys were examined with a scanning electron microscope, and the structure stability of the alloys was evaluated.

Table 2 shows the conditions of the characteristics evaluation tests which were performed for the alloy test pieces.

TABLE 2

| Evaluation Tests | Test Contents |
|---|---|
| Creep Rupture Test | Test Temperature and Stress 1255 K-138 MPa |
| Oxidation Test | Repeated Oxidation Test for 20 h in Atmosphere 1373 K-200 h |

TABLE 2-continued

| Evaluation Tests | Test Contents |
|---|---|
| Corrosion Resistance Test | Molten Salt Immersion Test 1123 K $NaSO_4$(75%) + NaCl(25%) |

The creep rupture test was performed under the conditions of 1255 K-137 MPa. As the high-temperature oxidation test, the oxidation test of holding at 1373 K for 20 hours was repeated ten times, and the respective changes of the mass were measured. Further, as the high-temperature corrosion test, the test of immersion in the molten salt at 1123 K (composition of $Na_2SO_4$: 75% and NaCl: 25%) for 25 hours was performed four times (100 hours in total), and the changes of the mass were measured.

These test results are tabulated and shown in Table 3.

TABLE 3

| Alloy No. | Room Temperature Tension Elongation RT | Creep Rupture Time (h) 1255 K 137 MPa | Oxidation Test Mass Change Amount (mg/cm$^2$) 1373 K 20 h × 10 | Corrosion Test Mass Change Amount (mg/cm$^2$) $NaSO_4$: 75% + NaCl: 25% 1123 K-25 h × 4 |
|---|---|---|---|---|
| 1 | 2.43% | 103 | −65.54 | −46.46 |
| 2 | 3.13% | 126 | −59.64 | −55.44 |
| 3 | 4.62% | 186 | −44.49 | −34.97 |
| 4 | 5.61% | 181 | −42.68 | −39.46 |
| 5 | 5.52% | 169 | −41.59 | −42.69 |
| 6 | 6.07% | 196 | −49.56 | −29.46 |
| 7 | 4.47% | 173 | −36.95 | −36.56 |
| 8 | 5.21% | 183 | −33.54 | −34.12 |
| 9 | 5.12% | 179 | −42.86 | −38.56 |
| 10 | 2.38% | 114 | −55.48 | −48.44 |
| 11 | 2.87% | 136 | −42.14 | −54.14 |
| 12 | 1.98% | 175 | −70.51 | −35.73 |
| 13 | 1.59% | 92 | −61.01 | −45.66 |

Figure 2:
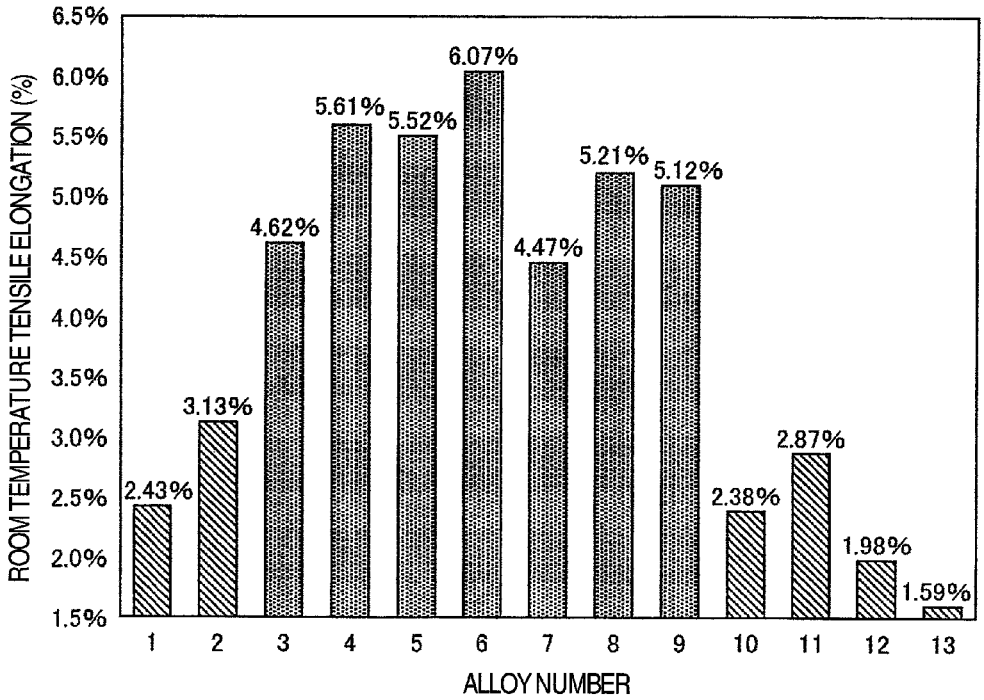
FIG. 2 is a graph showing elongations % of a tension test with respect to alloy test pieces.
Figure 3:
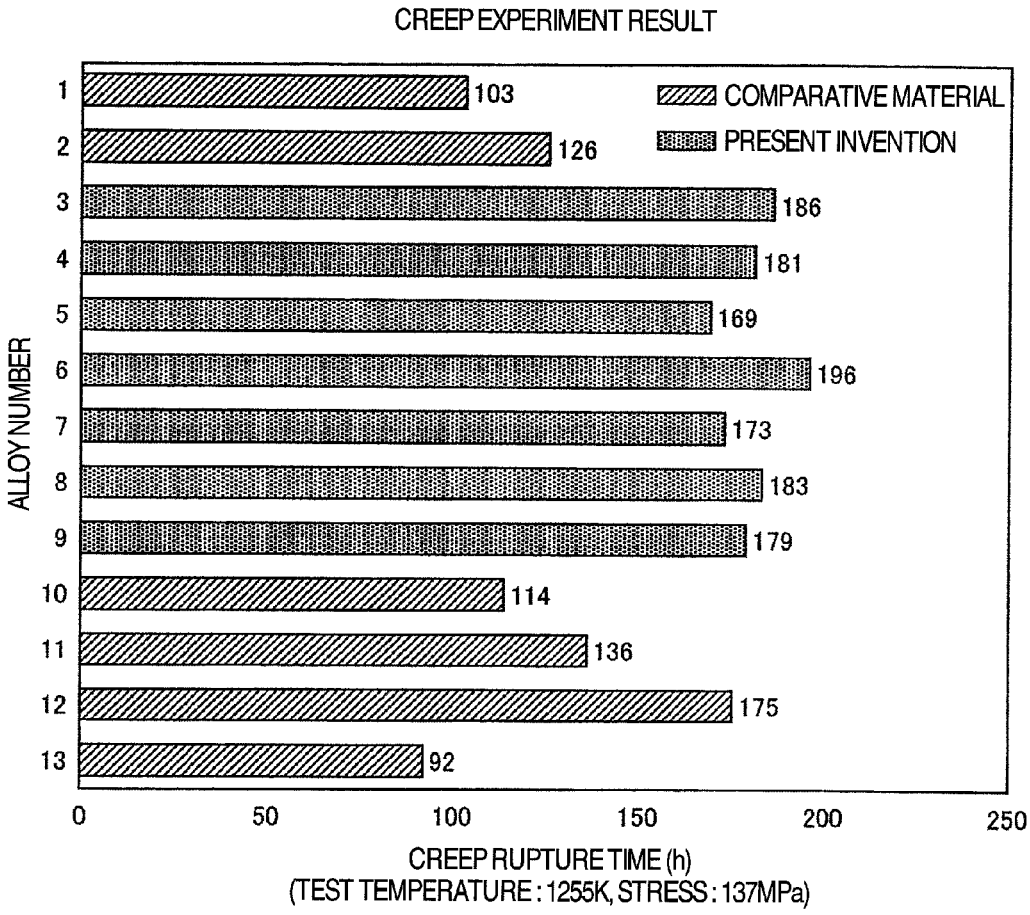
FIG. 3 is a graph showing creep rupture times with respect to the alloy test pieces.
Figure 4:
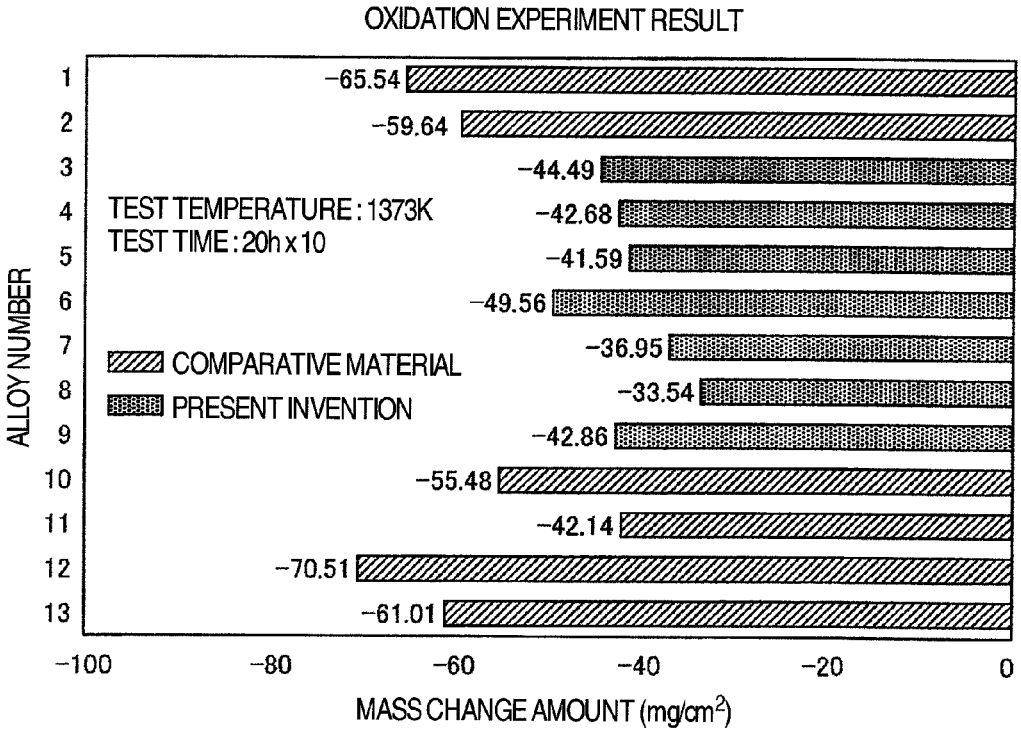
FIG. 4 is a graph showing oxidation loss in a high-temperature oxidation test with respect to the alloy test pieces.
Figure 5:
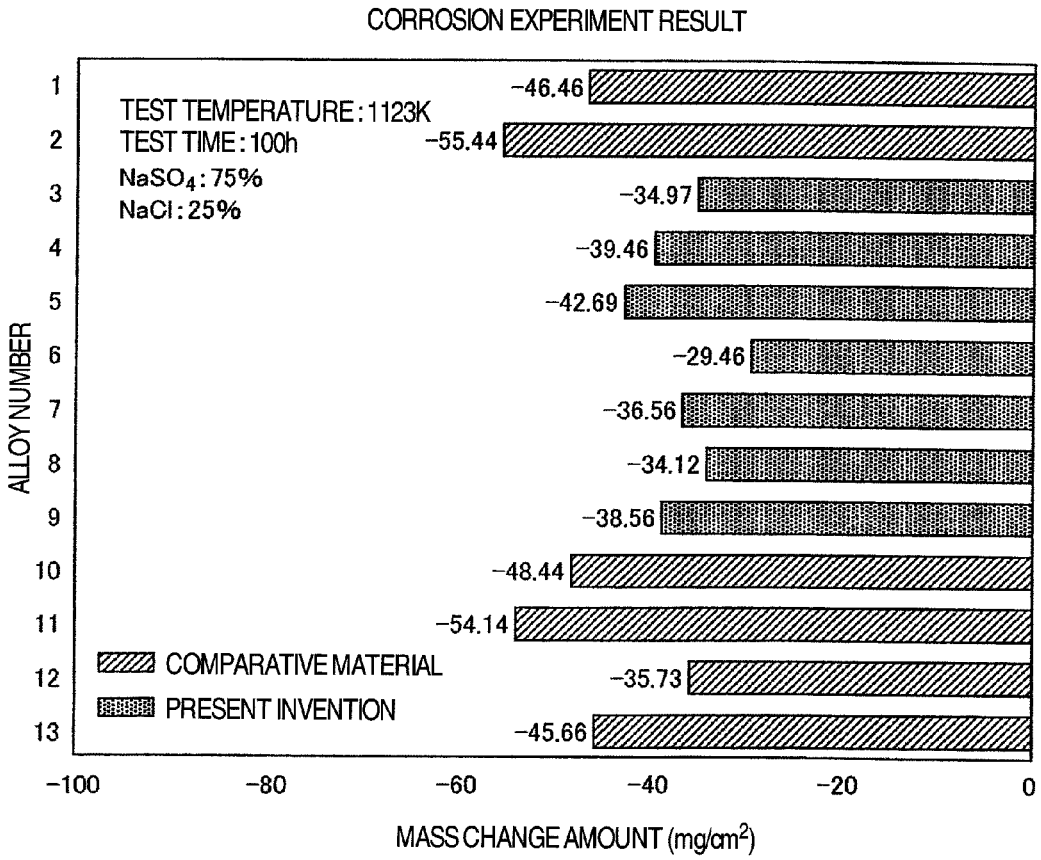
FIG. 5 is a graph showing corrosion loss in a molten salt immersion corrosion test with respect to the alloy test pieces.

FIGS. 2 to 5 show the characteristic evaluation test results of the respective alloys. FIG. 2 is a graph showing elongations % of tension test at room temperature. FIG. 3 is a graph showing the creep rupture time at 1123 K-314 MPa. FIG. 4 is a graph showing oxidation loss in the high-temperature oxidation test. And, FIG. 5 is a graph showing a measurement result of corrosion loss in the molten salt immersion corrosion test.

The result of the tension test at room temperature is shown in FIG. 2 with elongations %. The test result shows that the test material of the present invention is excellent in ductility at room temperature as compared with the test materials of the comparative examples.

Figure 1:
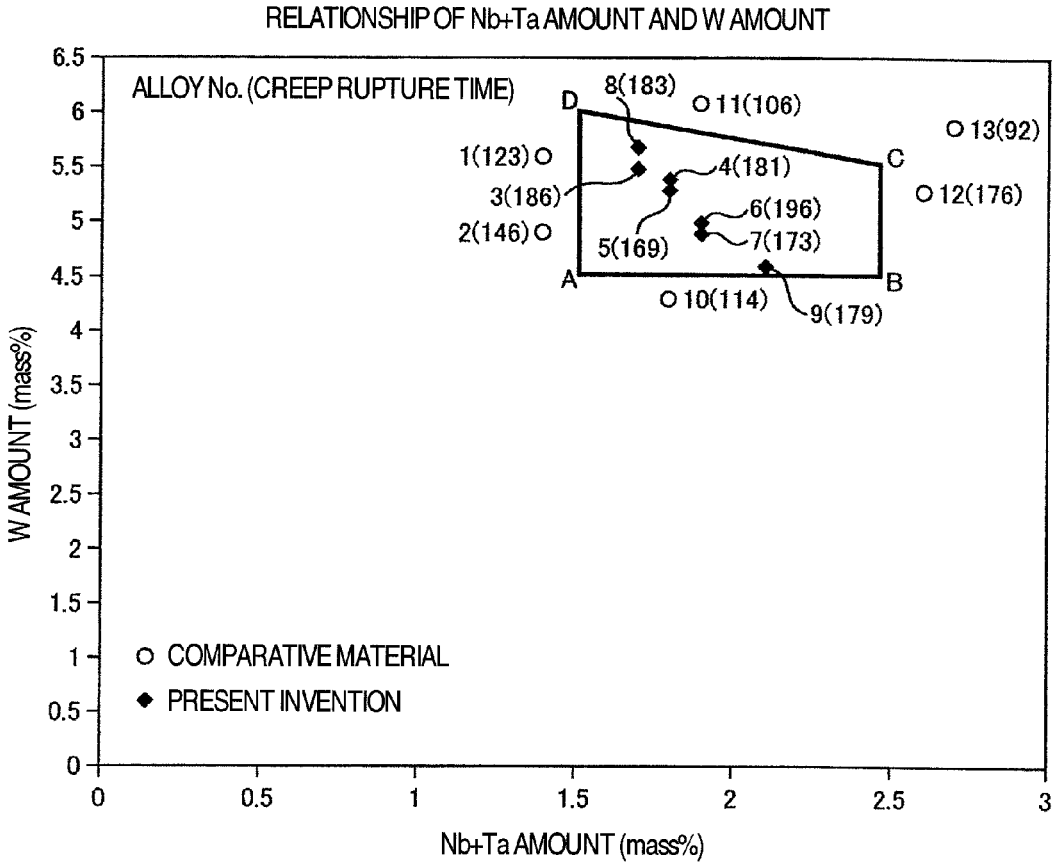
FIG. 1 is a diagram showing a relationship of a TA+Nb amount and a W amount.

Further, FIG. 1 is a diagram showing a relationship of a Ta+Nb amount and W, and FIG. 1 is the result of plotting Nos. 1 to 13. Further, the numerals in the parentheses show creep rupture times.

The alloys of Nos. 1 and 2 which have small amounts of Ta+Nb have small precipitation amounts of γ' phases, and have insufficient creep characteristics. In contrast with this, the alloy of No. 12 with a large amount of Ta+Nb has favorable creep characteristics, but is inferior in ductility.

As the amount of W becomes larger, creep seems to tend to be improved. However, when both the amounts of Ta+Nb and W become large as in the alloy of No. 13, precipitation of a harmful phase occurs, and both creep characteristics and ductility are reduced.

Further, as is obvious from the result shown in Table 3, the alloys of Nos. 3 to 9 of the present example have substantially the same oxidation resistance as compared with the exiting alloy GTD111, and are improved in creep strength and ductility.

Further, it is found out that as compared with another existing alloy Rene80, the alloys of Nos. 3 to 9 have substantially the same creep rupture strength, and are significantly improved in oxidation loss and also improved in corrosion resistance. In particular, improvement in the oxidation resistance is remarkable.

More specifically, it is confirmed that by the present invention, the Ni-based alloy with high ductility can be obtained without substantially sacrificing the creep rupture life, while corrosion resistance and oxidation resistance at high temperature are maintained.

In the above example, the effect of the present invention as an ordinary casting material is described. Furthermore, it is also very effective to use the alloy of the present invention as a unidirectional solidification blade which is unidirectionally solidified. It is a well-known fact that the creep rupture strength can be significantly improved while corrosion resistance and oxidation resistance characteristics are maintained by unidirectionally solidifying the alloy. In particular, the alloy of the present invention contains C and B, which have the effect in strengthening the crystal grain boundaries. Also, Hf, which has the effect in suppression of crystal grain boundary cracks at the time of casting, can be added to the alloy of the present invention in accordance with necessity. Therefore, the alloy of the present invention has the alloy composition which is suitable for use as a unidirectional solidification material.

As described above, according to the present invention, the Ni-based alloy, which has both good high-temperature strength and ductility and can be ordinarily casted, can be obtained.

Figure 8:
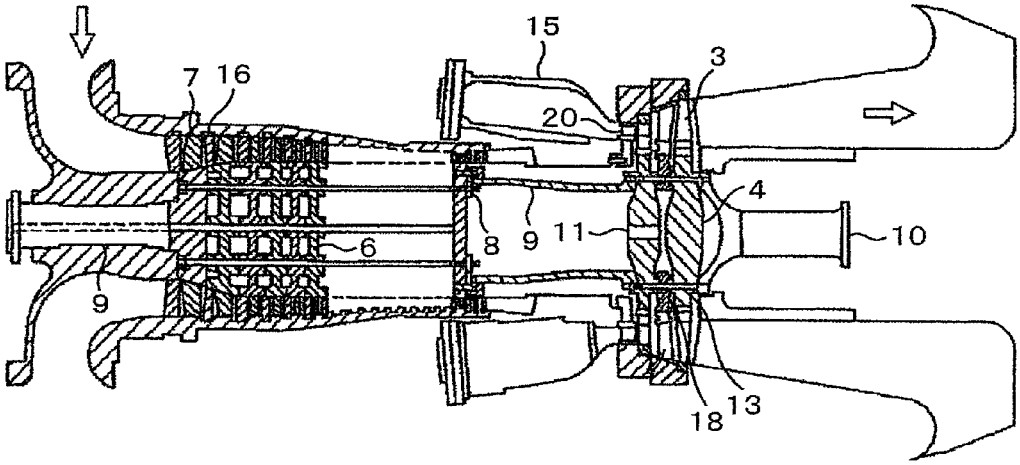
FIG. 8 is a view showing the gas turbine.

FIG. 8 is a view showing a gas turbine. In FIG. 8, reference numeral 3 designates a turbine blade. Reference numeral 13 designates a turbine stacking bolt. Reference numeral 18 designates a turbine spacer. Reference numeral 19 designates a distant piece. Reference numeral 20 designates an initial stage nozzle. Reference numeral 6 designates a compressor disk. Reference numeral 7 designates a compressor blade. Reference numeral 16 designates a compressor nozzle. Reference numeral 8 designates a compressor stacking bolt. Reference numeral 9 designates a compressor stub shaft. Reference numeral 4 designates a turbine disk. Reference numeral 11 designates a hole. And, reference numeral 15 designates a combustor.

The Ni-based alloy in the present invention has both high creep strength and ductility, and therefore, can be used in the third and fourth stage rotor blades and initial stage stator blade for a gas turbine as an ordinary casting material. The Ni-based alloy also can be used in the first and second stage rotor blades for a gas turbine as a unidirectional casting material.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A Ni-based alloy comprising chromium, cobalt, aluminum, titanium, tantalum, tungsten, molybdenum, niobium, carbon, and boron, the balance being nickel and incidental impurities, wherein the alloy has an alloy composition of, on the basis of mass percent, chromium: 13.10% to 16.00%, cobalt: 8.00% to 12.50%, aluminum: 2.30% to 3.50%, titanium: 4.80% to 5.50%, tantalum: 0.40% to less than 1.00%, tungsten: 4.50% to 6.00%, molybdenum: 0.10% to 1.50%, niobium: 0.60% to 1.70%, carbon: 0.01% to 0.20%, boron: 0.005% to 0.02%, and the balance: nickel and incidental impurities.

2. The Ni-based alloy according to claim 1, further comprising one kind or more elements selected from the group of hafnium, rhenium, zirconium, oxygen and nitrogen, wherein the alloy has the alloy composition of, on the basis of mass percent, hafnium: 0% to 2.00%, rhenium: 0% to 0.50%, zirconium: 0% to 0.05%, oxygen: 0% to 0.005%, and nitrogen: 0% to 0.005%.

3. The Ni-based alloy according to claim 2, wherein the alloy has the alloy composition of, on the basis of mass percent, hafnium: 0% to 0.10%, rhenium: 0% to 0.10%, zirconium: 0% to 0.03%, oxygen: 0% to 0.005%, and nitrogen: 0% to 0.005%.

4. The Ni-based alloy according to claim 1, wherein in a diagram showing a relationship of an amount of tantalum+niobium and an amount of tungsten, the composition is in a composition range enclosed by a line sequentially connecting a point A (1.5%, 4.5%), a point B (2.5%, 4.5%), a point C (2.5%, 5.5%) and a point D (1.5%, 6.0%) which are represented by (tantalum+niobium amount, tungsten amount).

5. The Ni-based alloy according to claim 1, wherein the alloy has the alloy composition of, on the basis of mass percent, chromium: 13.10% to 14.30%, cobalt: 8.50% to 11.00%, aluminum: 2.70% to 3.40%, titanium: 4.80% to 5.30%, tantalum: 0.50% to 0.90%, tungsten: 4.80% to 5.50%, molybdenum: 0.60% to 1.40%, niobium: 0.70% to 1.60%, carbon: 0.10% to 0.18%, and boron: 0.01% to 0.02%.

6. The Ni-based alloy according to claim 5, wherein the alloy has the alloy composition of, on the basis of mass percent, chromium: 13.70% to 14.10%, cobalt: 9.10% to 10.80%, aluminum: 3.00% to 3.40%, titanium: 4.80% to 5.10%, tantalum: 0.60% to 0.90%, tungsten:

4.80% to 5.40%, molybdenum: 0.70% to 1.30%, niobium: 0.80% to 1.50%, carbon: 0.12% to 0.17%, and boron: 0.01% to 0.02%.

7. A cast product, comprising the Ni-based alloy according to claim 1.

8. A turbine rotor blade for a gas turbine, comprising the Ni-based alloy according to claim 1.

9. A gas turbine using the gas turbine rotor blade or stator blade according to claim 8.

10. A turbine stator blade for a gas turbine, comprising the Ni-based alloy according to claim 1.

11. A gas turbine using the gas turbine rotor blade or stator blade according to claim 10.

* * * * *